US005579991A

United States Patent [19]

Strasevicz et al.

[11] Patent Number: 5,579,991

[45] **Date of Patent: *Dec. 3, 1996**

[54] DISPLAY CONTAINER FOR VANITY TOPS OR THE LIKE

[75] Inventors: Steven A. Strasevicz, Yorba Linda; Robert Shoults, Rancho Cucamonga, both of Calif.

[73] Assignee: Leucadia, Inc., New York, N.Y.

[ * ] Notice: The term of this patent shall not extend beyond the expiration date of Pat. No. 5,322,212.

[21] Appl. No.: 259,408

[22] Filed: Jun. 14, 1994

Related U.S. Application Data

[63] Continuation-in-part of Ser. No. 995,181, Dec. 22, 1992, Pat. No. 5,322,212.

[51] Int. Cl.[6] ..... B65D 5/20; B65D 85/00

[52] U.S. Cl. ..... 229/164; 206/320; 206/321; 229/117.16; 229/169; 229/174

[58] Field of Search ..... 229/117.16, 143, 229/147, 149, 164, 169, 174; 206/320, 321, 448, 591

[56] References Cited

U.S. PATENT DOCUMENTS

| | | | |
|---|---|---|---|
| D. 207,746 | 5/1967 | Cote . | |
| D. 278,126 | 3/1985 | Benham . | |
| D. 291,065 | 7/1987 | Pugh . | |
| D. 332,744 | 1/1993 | McCooey . | |
| 930,882 | 8/1909 | Perkins | 229/178 |
| 1,819,894 | 8/1931 | Hartman | 229/188 |
| 1,974,552 | 9/1934 | Wallbank | 206/44 |
| 2,278,359 | 3/1942 | Nagle . | |
| 2,307,720 | 1/1943 | Ringler | 229/147 |
| 2,509,447 | 5/1950 | Prawdzik . | |
| 2,642,218 | 6/1953 | Platt | 229/188 |
| 2,649,807 | 8/1953 | Ritter . | |
| 2,678,724 | 5/1954 | Andriot, Jr. . | |
| 2,779,463 | 1/1957 | Zimmerman . | |

(List continued on next page.)

FOREIGN PATENT DOCUMENTS

| | | | |
|---|---|---|---|
| 482947 | 5/1952 | Canada | 229/178 |
| 394549 | 10/1990 | European Pat. Off. | 229/164 |

OTHER PUBLICATIONS

Modern Packaging, 1972–1973, p. 134 bottom left of page. Corner piece/edge protector, as shown in photographs (9 in number).

Box drawings/specifications, 3 pages, all carrying hand notation P+K and two carrying hand-written 1988 date notation.

*Primary Examiner*—Gary E. Elkins

*Attorney, Agent, or Firm*—Robbins, Berliner & Carson

[57] ABSTRACT

A container for displaying and transporting a heavy product, such as a vanity top, is fabricated and assembled as an integral unit to secure the product against possible damage while permitting the product to be easily transported and viewed by prospective purchasers. Each of its pair of side wall panels has an elongated central flap section which is hinged and folded inwardly to define a generally front-facing double fold front surface for the container slanted in a front and back direction and elongated in a direction generally transverse to the top and bottom wall panels. An upper end flap hinged along an upper edge of each side wall panel is at least in part folded inwardly in spaced generally parallel relation to the side wall panel, defining a surface extending generally transverse to the top and bottom wall panels to block movement of the product toward the back panel. Central, upper and lower pairs of overlapping rounded tabs are cut in the side wall panels and in the intermediate flap sections. These tabs are bent inwardly in assembling the container to secure the side wall panels and intermediate flap sections together. Additional tabs are provided on upper and lower side flaps to overlap with the upper and lower pairs of tabs. These additional tabs are also bent inwardly with the upper and lower tab pairs to aid in securing these side flaps in place.

54 Claims, 4 Drawing Sheets

U.S. PATENT DOCUMENTS

| | | | |
|---|---|---|---|
| 2,998,909 | 9/1961 | Anderson, Jr. et al. | 229/169 |
| 3,034,697 | 5/1962 | Frankenstein | 229/169 |
| 3,038,513 | 6/1962 | Hamlett . | |
| 3,043,492 | 7/1962 | Stewart, Jr. . | |
| 3,099,351 | 7/1963 | Coffey, Jr. . | |
| 3,133,633 | 5/1964 | Redmond . | |
| 3,173,596 | 3/1965 | Aust et al. | 229/22 |
| 3,289,825 | 12/1966 | Smith . | |
| 3,343,744 | 9/1967 | Morell et al. | 229/27 |
| 3,363,749 | 1/1968 | Tinapple . | |
| 3,375,967 | 4/1968 | Robinson | 229/34 |
| 3,397,772 | 8/1968 | Farquhar | 206/45.14 |
| 3,616,989 | 11/1971 | Martinek et al. | 229/178 |
| 3,880,287 | 4/1975 | Loeffelman . | |
| 3,884,356 | 5/1975 | Lidgard | 206/521 |
| 3,987,893 | 10/1976 | Hanson . | |
| 3,989,139 | 11/1976 | Vargo . | |
| 3,999,658 | 12/1976 | Anderson | 206/320 |
| 4,053,101 | 10/1977 | Hart, Jr. | 229/36 |
| 4,082,215 | 4/1978 | Eichenauer | 229/143 |
| 4,133,428 | 1/1979 | Gloyer . | |
| 4,155,445 | 5/1979 | Roccaforte . | |
| 4,244,509 | 1/1981 | Dlugopolski | 229/36 |
| 4,262,804 | 4/1981 | Nelson, Jr. | 206/561 |
| 4,349,147 | 9/1982 | Jensen | 229/143 |
| 4,356,952 | 11/1982 | Rekow | 229/34 R |
| 4,385,687 | 5/1983 | Dutcher . | |
| 4,418,863 | 12/1983 | Kimbrell, Sr. | 229/143 |
| 4,574,998 | 3/1986 | Vavra . | |
| 4,641,746 | 2/1987 | Dornbusch et al. | 206/44 R |
| 4,662,512 | 5/1987 | Durand | 206/45.14 |
| 4,667,825 | 5/1987 | Durand | 229/164 |
| 4,671,413 | 6/1987 | Peterson . | |
| 4,715,493 | 12/1987 | Dreyfus . | |
| 4,759,446 | 7/1988 | Dobashi et al. . | |
| 4,807,746 | 2/1989 | Jacobs . | |
| 4,811,840 | 3/1989 | Muyskens . | |
| 4,860,948 | 8/1989 | Hofstede | 229/169 |
| 4,871,068 | 10/1989 | Dreyfus . | |
| 4,883,221 | 11/1989 | Brundage | 229/174 |
| 5,163,609 | 11/1992 | Muise, Jr. | 229/178 |
| 5,322,212 | 6/1994 | Strasevicz et al. | 229/164 |
| 5,429,232 | 7/1995 | Orr et al. | 229/178 |

FIG. 1
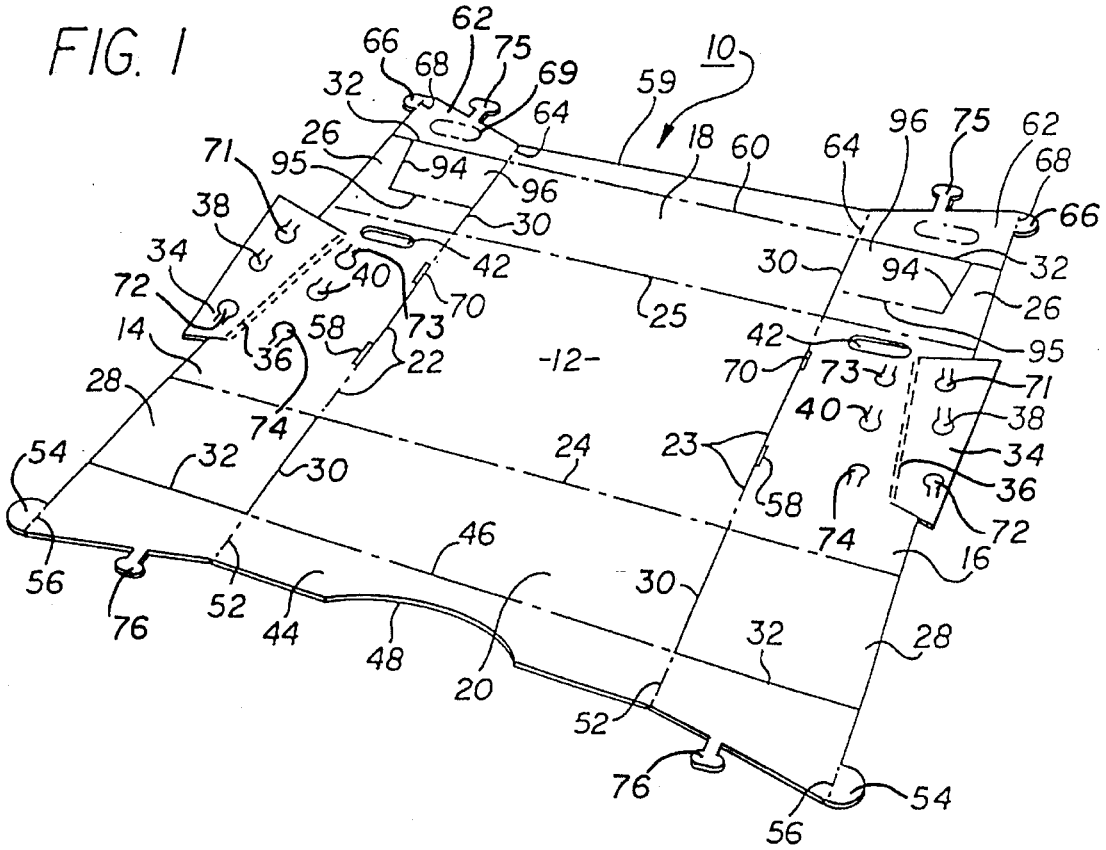
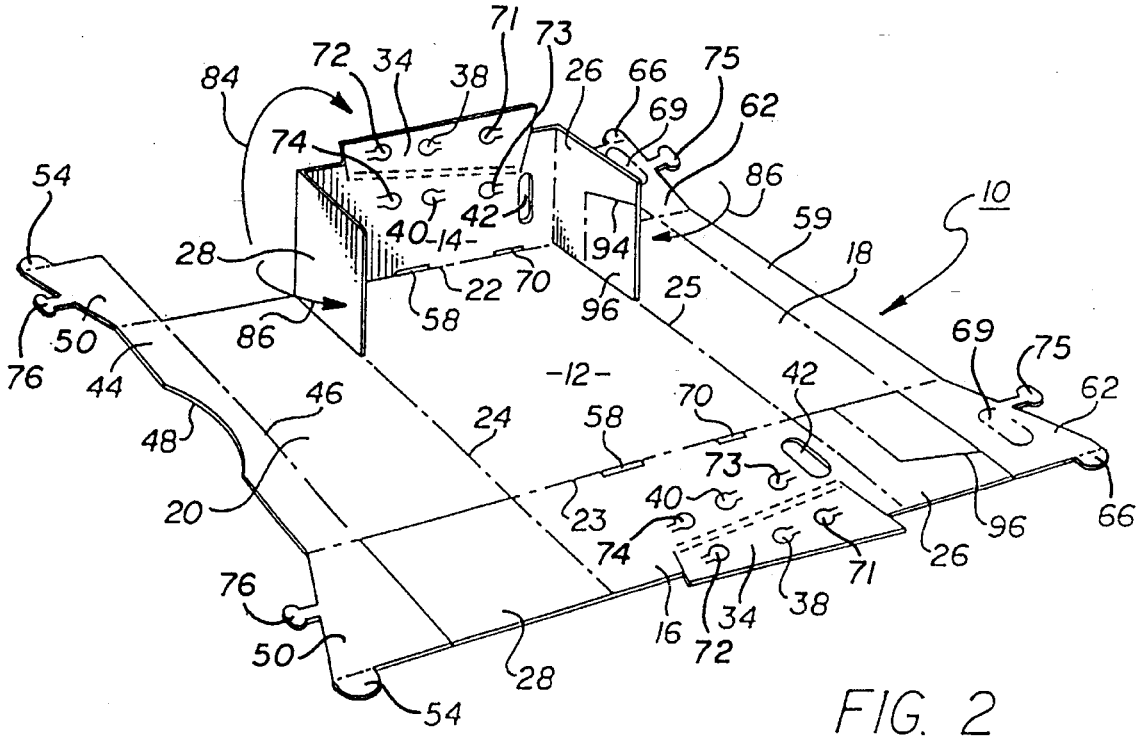
FIG. 2

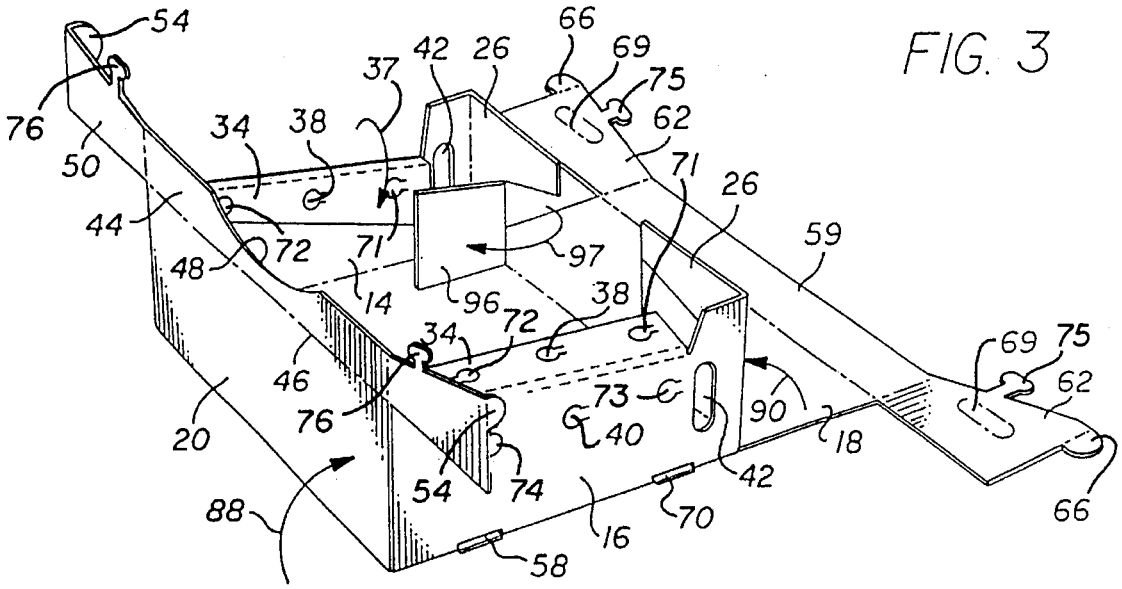
FIG. 3
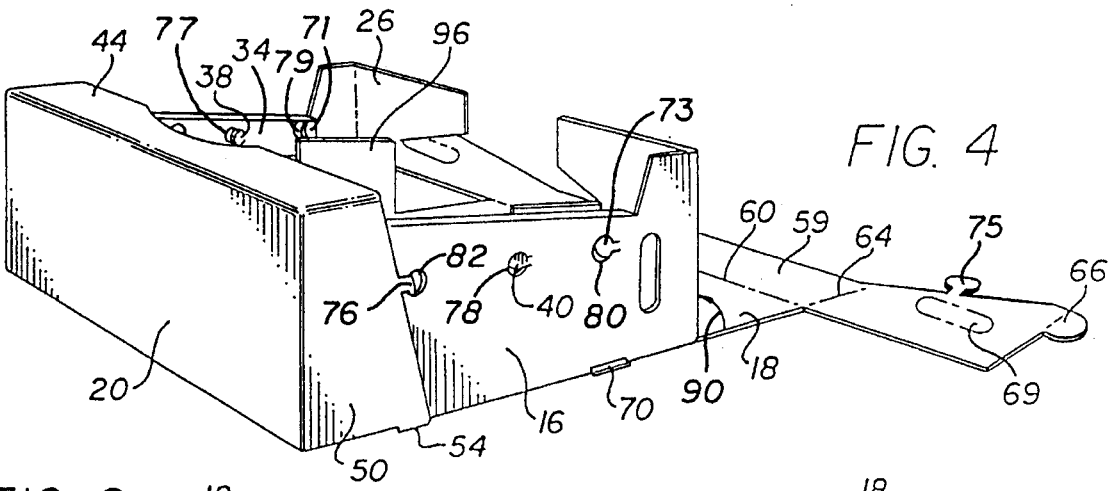
FIG. 4
FIG. 6
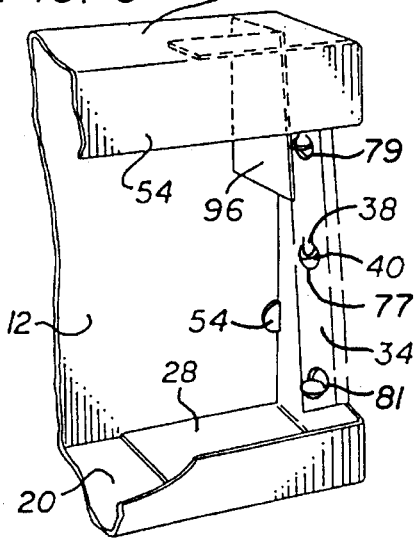
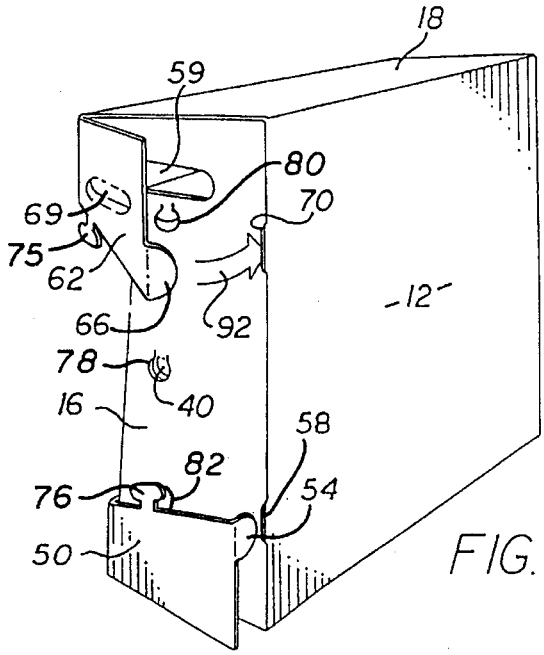
FIG. 5

FIG. 7
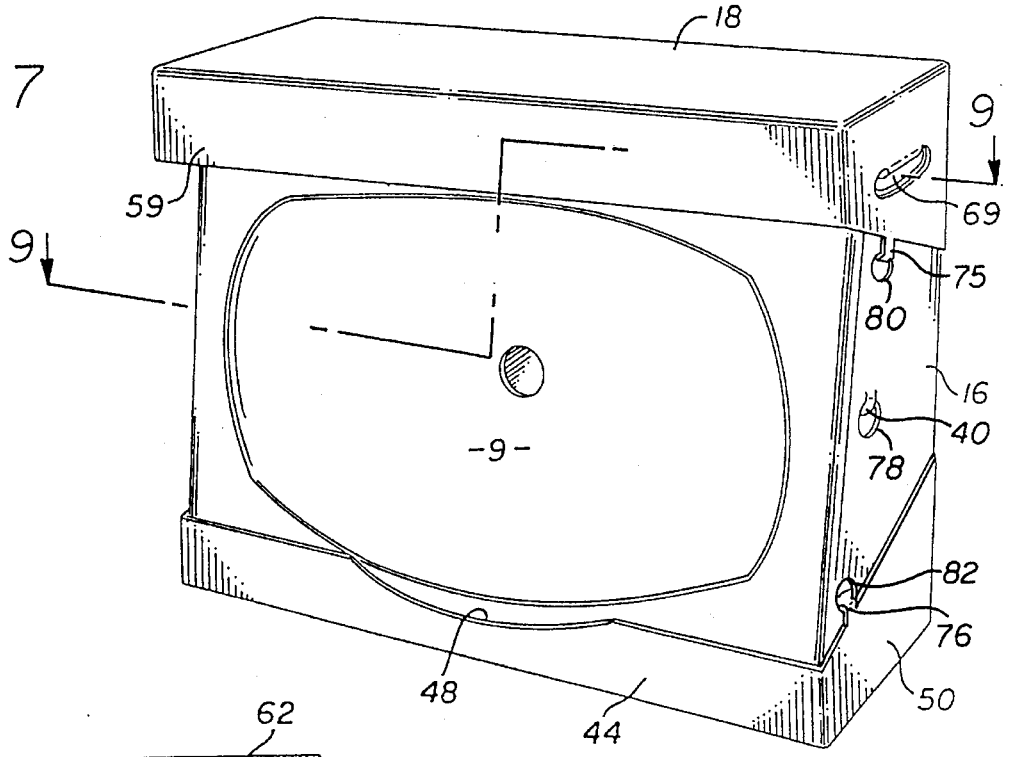
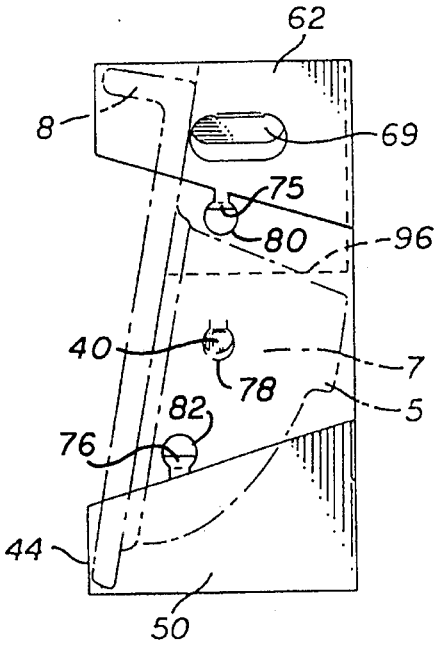
FIG. 8
FIG. 9
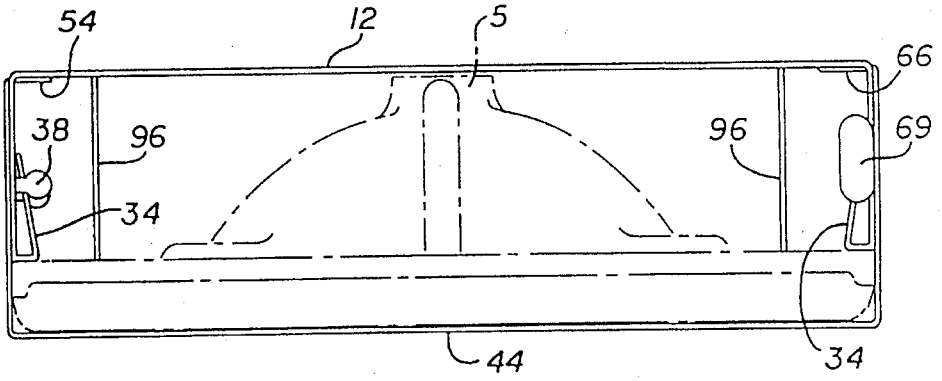

DISPLAY CONTAINER FOR VANITY TOPS OR THE LIKE

This application is a continuation-in-part of application Ser. No. 07/995,181, filed Dec. 22, 1992 now U.S. Pat. No. 5,322,212.

BACKGROUND OF THE INVENTION

The present invention relates to packaging, and more particularly to composite packaging for transporting and displaying vanity tops that have the bowl, surrounding top and splash panel formed as an integral unit using cultured marble materials or the like.

After being manufactured, vanity top assemblies and the like are commonly packaged for shipment from the factory to be distributed and sold to customers for installation. Frequently retailers and wholesalers want to display such products so that the color and surface texture can be viewed by the prospective buyers to insure that it matches their decorative needs. In the past, retailers and wholesalers often had to either cut openings in the container boxes so that the product could be viewed or actually remove one of the products from its shipping box display as a sample. However, cutting out a port&on of the box entailed the risk of damaging or marring the smooth marble-like surface or of destroying the structural integrity of the container that the buyer used to transport his purchase. Also, the effort involved in cutting individual boxes or removing the product for display subjected the seller to unwanted labor expenses and inconvenience.

SUMMARY OF THE INVENTION

The present invention provides a container assembly for displaying and transporting vanity tops and the like that is fabricated and assembled as an integral unit to secure the product against possible damage while permitting the product to be easily transported and viewed by prospective purchasers.

In accordance with the container embodiment of this invention shown and described in detail herein, the container assembly is integrally formed from a single sheet of composite packaging material, preferably corrugated paperboard, cardboard or stiffened plastic sheeting. The sheet is cut and creased to define a rectangular back panel with hinged side, top and bottom wall panels that are interleaved and interlock to enclose the product within the container.

The top, bottom and side wall panels are secured together without glue or adhesive by means of strategically arranged flaps with interlocking tabs. Specifically, interlocking tabs are formed at the outer end of wedge-shaped flaps that extend outwardly on either side of the narrow front extensions on the top and bottom panels be to engaged in slots cut along the fold or crease lines where the side panels are hinged on either side to the back panel. By this means, the vanity top is frontally restrained at its top and bottom against the inner surface of the narrow front extensions while otherwise being exposed to view for display purposes.

In addition, both side panels are provided with overlapping intermediate flaps or side wall extensions that fold inwardly to provide a double thickness for added structural rigidity in supporting and cushioning the undersurface of the vanity top along both side edges. Also, end flaps hinged at the top and bottom of the side panels fold inwardly to overlie the inner surface of the top and bottom panels to provide a double sheet thickness to cushion and support the back and front edges of the vanity top at the top and bottom of the container.

Specifically, the downwardly folded narrow top panel extension folds downwardly to cover and confine the splash panel at the back of the vanity top assembly, and the narrow front extension on the bottom panel folds upwardly to cover and confine the front edge of the vanity top. Elongated oval shaped handle tabs cut into the wedge-shaped flaps at either end of the narrow front extensions on the top panel are hinged along their top edge to overlap and register with identical oval shaped handle openings cut near the top of both side panels whereby the oval tabs can be pushed inwardly to interlock with the side panel, thereby adding structural rigidity and providing sturdy handle openings for comfortably lifting and carrying the container.

To enhance the integrity of the box structure, central, upper and lower pairs of overlapping rounded tabs are cut in the side wall panels and in the intermediate flaps or side wall extensions that fold inwardly to provide the double thickness along the sides of the container. These tabs are bent inwardly in assembling the container to secure the side wall panels and intermediate flaps together. Additional tabs are provided on upper and lower side flaps to overlap with the upper and lower pairs of tabs. These additional tabs are also bent inwardly with the upper and lower tab pairs to aid in securing these side flaps in place.

With this box structure, almost the entire face of the vanity top or similar product, except for the narrow top and bottom portions covered by the narrow front extensions on the top and bottom panels, remains open to view for display purposes so that the color and texture of the product can be inspected by prospective purchasers without removing the product from or cutting into the container, while also being securely held and cushioned for convenient shipping and handling.

BRIEF DESCRIPTION OF THE DRAWINGS

FIG. 1 is a top perspective view showing a flat planar sheet of box material, such as cardboard, that is cut and creased to form a vanity top container in accordance with the invention;

FIG. 2 is a side perspective view of the vanity top container of FIG. 1 showing one of the side panels with its top and bottom flaps folded into position during assembly;

FIG. 3 is another side perspective view showing the vanity top container of FIGS. 1 and 2 partially assembled with both side panels having their top, bottom and center flaps folded into position and with the bottom panel folded inwardly;

FIG. 4 is a further bottom side perspective view showing the vanity top container of FIGS. 1, 2 and 3 in a further stage of assembly with the narrow front extension on the bottom panel folded inwardly across the front opening and the wedge-shaped flaps folded downwardly into position along the side panels;

FIG. 5 is a side and back perspective view of the preferred form of the vanity top container illustrated in FIGS. 1–4 showing the top panel folded into the position with its narrow front extension and wedge-shaped flaps folded inwardly for insertion of the end tabs into slots formed adjacent the fold lines between the back and side panels;

FIG. 6 is a partial front perspective view of one side of the fully assembled vanity top container in accordance with the invention as illustrated in FIG. 1–5 showing the interleaving of the top, bottom and side panels and flaps;

FIG. 7 is a front perspective view of the fully assembled vanity top container, as illustrated in FIG. 1–6, supporting and enclosing a typical vanity top assembly;

FIG. 8 is a side plane view of the fully assembled container enclosing a vanity top assembly, as illustrated in FIG. 7, with the covered portions of the enclosed vanity top assembly shown in phantom outline;

FIG. 9 is a top sectional view of the fully assembled container taken along the lines 9—9 with the position of the enclosed vanity top assembly shown in phantom outline.

DETAILED DESCRIPTION

Figure 10:
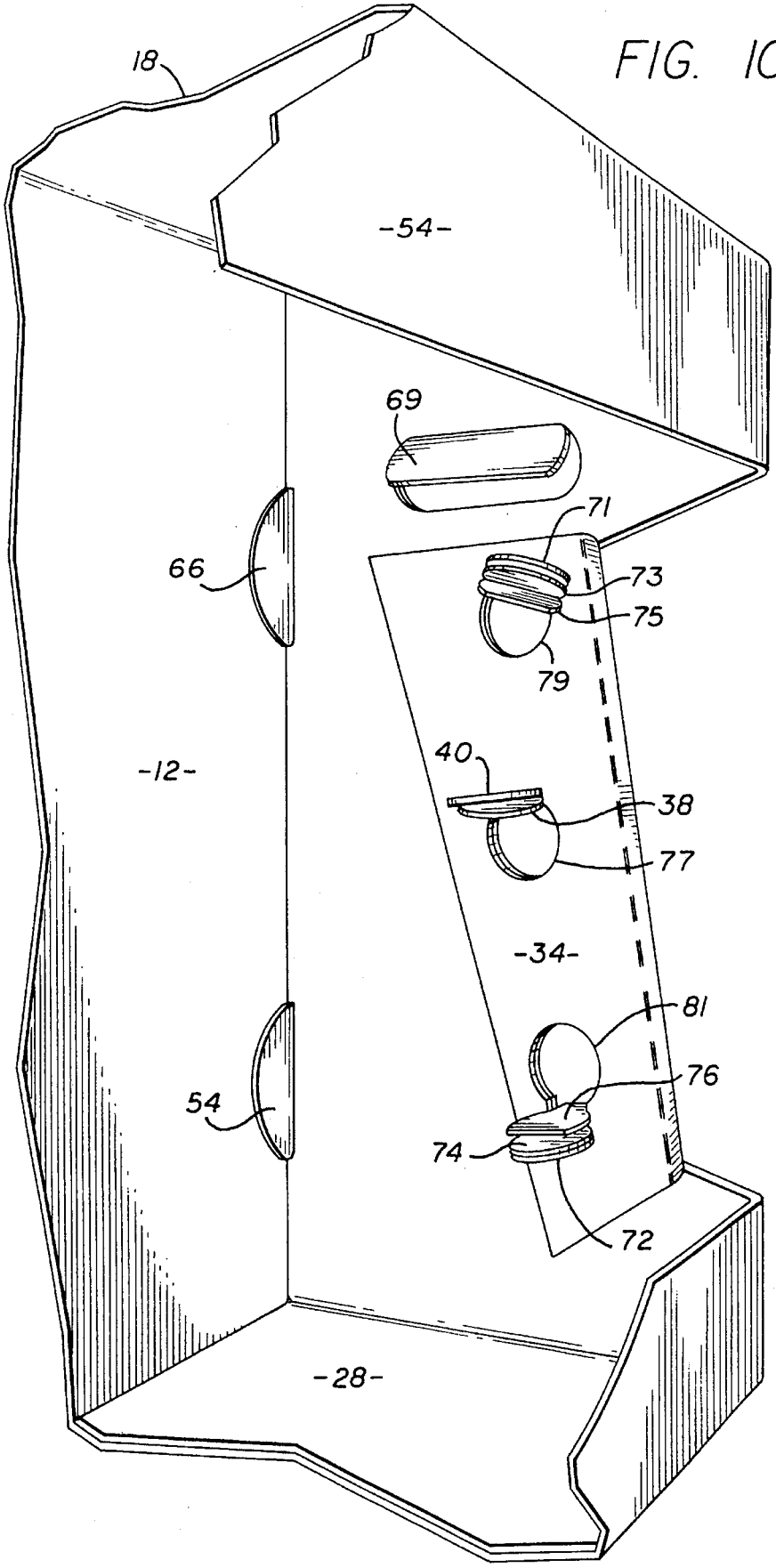
FIG. 10 is an enlarged, partially broken away view, showing the fully assembled side panel and side panel central flap arrangement of FIG. 6.

Referring now to FIG. 1, a vanity top container structure 10, in accordance with the invention, is formed from a single planar rectangular sheet of box material, such as cardboard, corrugated paperboard or stiffened plastic sheeting, by use of a single die having sharp blade edges to make cuts through the sheet material, as illustrated by the solid lines in the drawing, and blunted edges that are pressed into the sheet to form crease or fold lines, as illustrated by the dashed lines in the drawing. With a properly sized rectangular sheet stock, the amount of waste material cut from the edges is kept to a minimum.

The cardboard container structure 10 has a large rectangular shaped back panel 12 surrounded by rectangular left and right side wall panels 14 and 16 and rectangular top and bottom wall panels 18 and 20 that are hinged to be folded inwardly along their respective crease lines 22, 23, 24 and 25 to extend at right angles to the back panel 12, as best illustrated in FIGS. 2 and 3. The left and right side wall panels 14 and 16 both have substantially square upper and lower end flaps 26 and 28, formed at opposite ends with cut lines 30 and 32 intersecting at right angles to separate the sheet material forming the upper and lower flaps 26 and 28 from the sheet material forming the top and bottom wall panels 18 and 20.

An elongated wedge-shaped center flap or center extension 34 that extends along the outer edge intermediate the top and bottom edges of each side wall panel 14 and 16 is formed by cut lines that extend inwardly from the outer edge to intersect the opposite ends of a double fold or crease line 36 (formed along short, separated cuts, to ease the folding, as indicated by the dashes in the drawing) that allows the wedge-shaped center flaps 34 to fold inwardly, as shown by the directional arrow 37 in FIG. 3, to overlap the adjacent inner surface of each side wall panel 14 and 16. A small rounded center tab 38 cut near the middle of each center flap 34 is positioned to overlie a substantially identically shaped rounded center tab 40 cut into each side wall panel 14 and 16 so that, when the flap 34 is doubled over onto the inner surface of the side wall panel 14 or 16, both center tabs 38 and 40 can be pushed inwardly together as shown in FIGS. 4, 5, 6 and 10, to secure the center flaps 34 in that position. An elongated oval shaped handle slot 42 is cut into both side wall panels 14 and 16 parallel to and displaced a short distance down from the upper edge.

The rectangular bottom wall panel 20 has a narrow lower front extension 44 hinged along a crease line 46 to be folded inwardly at right angles to the bottom wall panel 20. The narrow lower front extension 44 is roughly rectangular but may have a shallow concavely curved center area 48 cut out to increase the viewing area. A wedge-shaped side flap 50 extends out from either end of the narrow lower front extension 44 and is hinged along the crease line 52 to fold inwardly at right angles to the lower front extension 44, as best illustrated in FIG. 4. Rounded end tabs 54 at the upper end of the side flaps 50 are hinged along fold or crease lines 56 to bend inwardly at right angles for insertion into narrow slots 58 cut into the adjacent side wall panels 14 and 16 alongside the crease lines 22 and 23, respectively, as best illustrated in FIG. 5.

The rectangular top wall panel 18 has a narrow upper front extension 59 hinged along a crease line 60 to be folded inwardly at right angles to the top wall panel 18. A wedge-shaped side flap 62 extends outwardly from and is hinged at either end of the upper front extension 59 to fold inwardly at right angles along crease lines 64. Each side flap 62 has a rounded tab 66 formed at its outer end that is hinged along a crease line 68 to fold inwardly at right angles for insertion into a narrow upper slot 70 cut into the adjacent side panels 14 and 16 alongside the crease lines 23, as best illustrated in FIG. 5.

With respect to the carton, there also are additional tab arrangements related to the center side wall and center flap tab arrangement previously described. These related arrangements are near the tops and bottoms of each side wall panel 14 and 16. As shown in FIGS. 4, 5, 6 and 10, a small rounded upper tab 71 and a small rounded lower tab 72 cut near the top and bottom of each center flap or extension 34 is positioned to overlie a substantially identically shaped upper tab 73 and lower tab 74 cut into each side wall panel. An upper side flap tab 75 provided on each upper side flap 62 is also present, positioned to substantially overlie the corresponding upper tab 71 of each side wall panel. Similarly, a lower side flap tab 76 provided on each lower side flap 50 is present in a position to substantially overlie the corresponding lower tab 72 of each side wall panel. In the assembled container, then, the set of three upper tabs on each side can be positioned inwardly together to aid in securing the center flap 34 as well as the upper side flap 60; and the set of three lower tabs on each side can similarly be positioned inwardly together to aid in securing the center flap as well as the lower side flap 50.

In the assembled container, the displacement of each center flap center tab 38 by the corresponding side wall center tab 40, and the secured, assembled position of these tabs, leaves a center flap center opening 77 and a side wall center opening 78. Similarly, the displacement of each center flap upper tab 71 by the corresponding side wall upper tab 73 and corresponding upper side flap tab 75, the displacement of the side wall upper tab 73 by the upper side flap tab 75, and the secured, assembled positions of these tabs, leaves a center flap upper opening 79 and a side wall upper opening 80. Essentially the same situation exists near the bottom of each side of the container concerning displacement of the center flap lower tab 72 by the side wall lower tab 74 and lower side flap tab 76, concerning the displacement of the side wall lower tab 74 by the lower side flap tab 76, and concerning the presence of a center flap lower opening 81 and a side wall lower opening 82.

As can be seen from the drawings, all of these center flap tabs, side wall tabs and upper and lower side flap tabs are keyhole-shaped. And all except the upper and lower side flap tabs 75 and 76 are circular in shape with the circle then broken by the intersection of a strip of the carton material having parallel edges. In the case of the upper and lower flap tabs, the circular shape is cut off so that one part of the circular outline, instead, is a straight line. This is for ease of fabrication of the carton. The corresponding center flap and side wall cuts which provide the tabs and the openings left by the displaced and secured tabs, of course, have corresponding keyhole shapes. As is apparent, this keyhole shape is adapted to the functions performed by the tabs and openings.

In assembling the container 10, the back panel 12 is placed on a level work surface, and both side wall panels 14 and 16 are folded inwardly, as shown by the directional arrow 84 in FIG. 2, to be positioned at right angles to the back panel 12 with the attached upper and lower end flaps 26 and 28 folded inwardly, as shown by the directional arrow 86 in FIG. 2. The center flaps 34 are also folded inwardly along the double fold or crease lines 36 to overlap the inner surface of the respective side wall panel 14 or 16, and the overlapping sets of rounded tabs 38 and 40, 71 and 73, and 72 and 74, on each center flap-side wall panel pair are pushed inwardly together to interlock with one another thereby forming a double thickness surface for supporting the undersurface of the product along its side edges.

With the side wall panels 14 and 16 and the attached upper, lower and center flaps 26, 28 and 34 folded into position, the bottom wall panel 20 is folded inwardly, as shown by the directional arrow 88 in FIG. 3, to abut the bottom edges of the side wall panels 14 and 16. In that position, the side flaps 50 at either end of the narrow lower front extension 44 can be folded inwardly so they extend along the lower portion of the respective side wall panels 14 and 16, as shown in FIG. 4, to place the end tabs 54 adjacent the narrow lower slots 58 cut in the adjacent side wall panels 14 and 16 alongside the crease lines 22 and 23 where the side wall panels 14 and 16 are hinged to the back panel 12, and to place the lower side flap tabs 76 near the side wall lower openings 82.

Similarly, the top wall panel 18 is folded inwardly, as shown by the directional arrow 90 in FIG. 4, to contact the top edges of the side wall panels 14 and 16, and the narrow upper front extension 59 is folded over onto the front edges of the side wall panels 14 and 16. The wedge-shaped side flaps 62 at either end are then folded inwardly and downward to position the end tabs 66 for insertion into the narrow upper slots 70 cut in the adjacent side wall panel 14 or 16 alongside the crease lines 22 and 23, as shown by the directional arrow 92 in FIG. 5, and to position the upper side flap tabs 75 for insertion through the side wall and center flap upper openings 80 and 79. Hinged elongated oval shaped tabs 69 register with the oval handle openings 42 in the side wall panels 14 and 16 where they can be pushed inwardly for carrying.

In the vanity top assembly configuration 9 as illustrated herein, the outer ends of the upper end flaps 26 attached to the side wall panels 14 and 16 are cut longitudinally along a line 94 that extends at an angle from the outermost edge to intersect an intermediate fold line 95, thus forming a wedge-shaped inner flap section 96 that folds inwardly at right angles to the rest of the flap 26. In this position, the inner flap section 96 on either side makes contact with the undersurface of the vanity top product 9 along a line extending from underneath the splash shield 8 at the back inwardly on either side of the convexly protruding bowl 7 to firmly position the product within the container.

During assembly, the cut and grooved sheet 10 should be laid flat on a level work surface that firmly supports at least the back panel 12. The side wall panels 14 and 16 are then folded upward and inwardly, and their hinged lower end flaps 28 are folded inwardly, as illustrated in FIG. 2, to be mutually perpendicular both to the plane of the back panel 12 and the side wall panels 14 and 16. The center flaps or extensions 34 on both side wall panels 14 and 16 are folded inwardly along the double fold or crease line 36, as illustrated by the directional arrow 37 in FIG. 3, to overlap the inner surface so the sets of rounded tabs 38 and 40, 71 and 73, and 72 and 74, which register with one another, can be pushed in together through the surrounding openings to lock the center flap 34 in its folded overlapping position. The upper surface (in the drawing orientation) extending along the double fold 36 on both side wall panels 14 and 16, which in this case is sloped, can then support the undersurface at the edges on both sides of a vanity top assembly.

After the side wall panels 14 and 16 with their attached lower end flaps 28 are properly positioned, the bottom wall panel 20 is folded upward and inwardly at right angles to the back panel 12 to abut the lower edges of both side wall panels 14 and 16. The lower front extension 44 is folded over at right angles to the bottom wall panel 20, and the wedge-shaped flaps 50 are folded inwardly where the end tabs 54 can be inserted into the lower slots 58 cut into the side wall panels 14 and 16 adjacent the crease lines 23, and the lower side flap tabs 76 can be inserted into the side wall and center flap lower openings 82 and 81.

At this point, a stable three sided box structure exists into which the vanity top can be inserted front edge first beneath the narrow lower front extension 44 to position the lower drain extension 5 near the center of back panel 12, as illustrated in FIGS. 8 and 9.

With the vanity top assembly in place, the container 10 can then be closed by first folding the upper end flaps 26 on the side wall panels 14 and 16 inwardly at right angles to abut the back edge of the splash panel 8. The wedge-shaped inner flap sections 96 below the angled longitudinal cuts 94 are then folded inwardly along the crease lines 95, as shown by the directional arrow 97 in FIG. 3, to be at right angles to the rest of the upper end flap 26. The top edges of the wedge-shaped flaps 96 then lie parallel to and coextensive in a common plane with the double fold surfaces in the side wall panels 14 and 16 to thus provide additional inboard support for the substantially planar back undersurface of the vanity top assembly. The top wall panel 18 is then folded inwardly to abut the upper edges of the side wall panels 14 and 16 while pushing the upper end flaps 26 against the top edge of the splash panel 8. The narrow upper front extension 59 hinged on the top wall panel 28 is folded over to cover the adjacent upper edge of the splash panel 8, and the wedge-shaped end flaps 62 at either end are bent downwardly so that the end tabs 66 can be inserted into the corresponding slots 70 cut in the side wall panels 14 and 16, and so that the upper side flap tabs 75 can be inserted into the side wall and center flap upper openings 80 and 79, thus completing the assembly.

To permit carrying, the elongated oval handle tabs 69 formed in the wedge-shaped end flaps 62 attached to the upper front extension 59 are pushed inwardly through the corresponding openings 42 in the side wall panels 14 and 16 so the hinged portion at the top of the elongated oval tabs 69 covers the upper edge of the opening 42 to provide a comfortable gripping surface on either side for moving or carrying the heavy vanity top in its container.

The vanity top assembly is thus secured against inward movement within the assembled container 10 along its under surface both at the outer side edges by the doublefold upper surface where the central wedge-shaped flaps or extensions 34 are hinged and also by the wedge-shaped inner flap sections 96 on the side wall panel end flaps 26. At the same time, the vanity top assembly is firmly restrained against outward movement by the narrow top and bottom front extensions 59 and 44 which leave almost the entire bowl and surrounding topsurface open to view for inspection by prospective customer.

The location of the interlocking tabs 54 at the outer upper end of the lower wedge-shaped flaps 50 assists in maintaining the structural integrity of the container assembly 10 by resisting the downward force exerted by the front edge of the vanity top assembly against the outer edge of the bottom wall panel 20. The restraining force is exerted diagonally along the path between the tabs 54 and the ends of the lower front extension 44 to resist both outward movement of the narrow lower front extension 44 and downward movement of the outer edge of the bottom wall panel 20. Also, the diagonal direction of the force exerted on the vertically positioned end tabs 54 increases the frictional contact of the tabs 54 against the inner surfaces of the slots 58 to resist pulling the tabs out of the slots.

Also, the downward force due to the weight of the vanity resting along the front edge of the bottom wall panel is further supported by the lower end flaps 28 attached to the respective side wall panels 14 and 16 so that the downward force is transmitted along the length of the side wall panels 14 and 16 to the handle openings 42. Similarly, the location of the tabs 66 on the upper wedge-shaped flaps 62 serve to transmit the lifting forces applied to the handle tabs 69 in carrying the container along a diagonal path to impart a twisting force that tends to maintain the end tabs 66 with increased frictional force against the internal surfaces of the upper slots 70 to resist their pulling free.

The invention has been described herein in connection with a carton embodiment intended for use with composite marble vanity top assemblies of the particular style and configuration illustrated, but it should be appreciated by those skilled in the art that various changes may be made in the particular configuration and shape of the different segments to accommodate other vanity top designs and similar products without departing from the overall spirit and scope of the invention as set forth in the appended claims.

What is claimed is:

1. A container for transporting a product, comprising:

a top wall panel;

a bottom wall panel;

a front wall panel;

a back wall panel; and two side wall panels;

at least one of said wall panels having an extension hinged along an edge of said panel, at least part of said extension in overlying adjacent relation to said wall panel;

at least one of said at least one wall panel and its extension having a tab adapted to interlock with said other one of said at least one wall panel and its extension, for releasably maintaining said overlying adjacent relation.

2. The container as defined in claim 1, wherein said other one of said at least one wall panel and its extension has an opening, said tab and said opening coacting for releasably maintaining said overlying adjacent relation.

3. The container as defined in claim 2, wherein a second tab is displaced from said opening by said first tab.

4. The container as defined in claim 1, further comprising:

an additional wall panel having a second tab adapted to interlock with said at least one of said wall panel and its extension having said first tab, for releasably maintaining said additional wall panel and said at least one of said wall panel and its extension in overlying adjacent relation.

5. The container as defined in claim 4, wherein said at least one of said wall panel and its extension having said first tab, has an opening, said second tab and said opening coacting for releasably maintaining said overlying adjacent relation.

6. The container as defined in claim 5, wherein said first tab is displaced from said opening by said second tab.

7. The container as defined in claim 4 wherein:

said other one of said wall panel and its extension has an opening, said first tab and said opening coacting for releasably maintaining said overlying adjacent relation of said wall panel and its extension; and said at least one of said wall panel and its extension having said first tab, has a second opening, said second tab and said second opening coacting for releasably maintaining said overlying adjacent relation of said additional wall panel and said at least one of said wall panel and its extension.

8. The container as defined in claim 7, wherein:

a third tab is displaced from said first opening by said first tab; and said first tab is displaced from said second opening by said second tab.

9. The container as defined in claim 8, wherein said second tab and said first opening coact for releasably maintaining said first and second overlying adjacent relations.

10. The container as defined in claim 1, formed integrally from a substantially rectangular planar sheet of stiffened packing material.

11. The container as defined in claim 1 wherein said extension is hinged along an edge of an intermediate portion of said at least one wall panel.

12. The container as defined in claim 1, formed of stiffened packing material.

13. The container as defined in claim 1, formed of corrugated paperboard.

14. The container as defined in claim 4, wherein said additional wall panel is connected to said top wall panel to hold said top wall panel closed.

15. A container for transporting a product, comprising:

a top wall panel;

a bottom wall panel;

a back wall panel;

a lower front extension extending from said bottom wall panel toward said top wall panel;

an upper front extension extending from said top wall panel toward said bottom wall panel, said upper and lower front extensions separated by a display opening for the product;

a pair of side wall panels extending from said back wall panel;

each of said side wall panels having an extension formed and hinged along an outer edge of said side wall panel, said extension folded such that said extension provides a generally front-facing, double fold front surface for the container slanted in a front and back direction and elongated in a direction generally transverse to said top and bottom wall panels.

16. The container as defined in claim 15, wherein said extension from each of said side wall panels is at least in part in overlying adjacent relation relative to said side wall panel.

17. The container as defined in claim 15, formed integrally from a substantially rectangular planar sheet of stiffened packing material.

18. A container for transporting a product, comprising:

a top wall panel;

a bottom wall panel;

a back wall panel;

a lower front extension extending from said bottom wall panel toward said top wall panel;

an upper front extension extending from said top wall panel toward said bottom wall panel, said upper and lower front extensions separated by a display opening for the product;

a pair of side wall panels extending from said back wall panel;

each of said side wall panels having an extension formed and hinged along an outer edge of said side wall panel, said extension folded such that said extension provides a generally front-facing, double fold front surface for the container elongated in a direction generally transverse to said top and bottom wall panels spaced to the rear of each of said upper and lower front extensions and sized to block rearward movement of the product with said front extensions resisting forward movement of the product.

19. The container as defined in claim 18, wherein said extension from each of said side wall panels is at least in part in overlying adjacent relation relative to said side wall panel.

20. The container as defined in claim 18, formed integrally from a substantially rectangular planar sheet of stiffened packing material.

21. A container for transporting a vanity top having a basin portion, a counter portion about the basin portion, an underside and a top side, comprising:

a top wall;

a bottom wall;

a back wall;

a lower front extension extending from said bottom wall toward said top wall;

an upper front extension extending from said top wall toward said bottom wall, said upper and lower front extensions separated by a display opening for the vanity top;

a pair of side walls connected to said back wall; and panel structure to support the vanity top by abutting the underside of a non-basin portion of the vanity top with the top side of the basin portion of the vanity top facing toward said display opening.

22. The container as defined in claim 21 wherein said panel structure comprises:

a pair of extensions, each formed and hinged along an outer edge of a said side wall, folded to provide said support.

23. The container as defined in claim 21 wherein said panel structure comprises:

a pair of end flaps, each formed and hinged along an edge of a said side wall, folded to provide said support.

24. The container as defined in claim 21, formed integrally from a planar sheet of stiffened packing material.

25. The container as defined in claim 21, wherein said back wall has a rectangular shape.

26. A container for transporting a heavy product having a top and a bottom, comprising:

a top wall panel;

a bottom wall panel;

a back wall panel;

a lower front extension extending from said bottom wall panel toward said top wall panel;

an upper front extension extending from said top wall panel toward said bottom wall panel, said upper and lower front extensions separated by a display opening for the product;

a pair of side wall panels extending from said back wall panel;

means for supporting said product slanted in a front and back direction with reference to the container with the top of said product facing toward said display opening.

27. The container as defined in claim 26 wherein said means for supporting comprises:

a pair of extensions, each formed and hinged along an outer edge of a said side wall panel, folded to provide said support.

28. The container as defined in claim 26 wherein said means for supporting comprises:

a pair of end flaps, each formed and hinged along an upper edge of a said side wall panel, folded to provide said support.

29. The container as defined in claim 26, formed integrally from a planar sheet of stiffened packing material.

30. A container for transporting a vanity top having a basin portion, a counter portion about the basin portion and a splash panel extending from such counter portion, comprising:

a top wall panel;

a bottom wall panel;

a back wall panel;

a lower front extension extending from said bottom wall panel toward said top wall panel;

an upper front extension extending from said top wall panel toward said bottom wall panel, said upper and lower front extensions separated by a display opening for the vanity top;

a pair of side wall panels extending from said back wall panel; and means for supporting said vanity top oriented with the basin portion facing toward said display opening.

31. The container as defined in claim 30 wherein said means for supporting comprises:

a pair of extensions, each formed and hinged along an outer edge of a said side wall panel, folded to provide said support.

32. The container as defined in claim 30 wherein said means for supporting comprises:

a pair of end flaps, each formed and hinged along an upper or lower edge of a said side wall panel, folded to provide said support.

33. The container as defined in claim 30, formed integrally from a planar sheet of stiffened packing material.

34. A rectangularly shaped container for transporting a vanity top having a top side and an underside, comprising:

top wall structure for closing a top end of the container;

bottom wall structure for closing a bottom end of the container;

back wall structure for closing a back of the container, said back wall structure including a pair of generally parallel and vertical sides defining outermost side edges of the back of the container, and wherein said back wall structure has a generally planar configuration extending between said outermost side edges;

a lower front extension extending vertically from said bottom wall structure toward said top wall structure;

an upper front extension extending vertically from said top wall structure toward said bottom wall structure, with said upper and lower front extensions being separated by a display opening for the vanity top;

a pair of opposed side wall structures connected to and extending from said back wall structure; and panel structure operably connected to each side wall structure for supporting the vanity top by abutting the underside of the vanity top with the top side of the vanity top facing toward said display opening.

35. A container formed of corrugated paperboard for transporting a product, comprising:

a top wall panel;

a bottom wall panel;

a back wall panel;

a lower front extension extending from said bottom wall panel toward said top wall panel;

an upper front extension extending from said top wall panel toward said bottom wall panel, said upper and lower front extensions separated by a display opening for the product;

a pair of side wall panels extending from said back wall panel;

each of said side wall panels having an extension formed and hinged along an outer edge of an intermediate portion of said side wall panel, substantially spaced from the top and the bottom of said side wall panel, said extension folded such that said extension provides a generally front-facing, double fold front surface for the container elongated in a direction generally transverse to said top and bottom wall panels.

36. The container as defined in claim 35, wherein said double fold front surface is spaced substantially to the rear of each of said upper and lower front extensions.

37. The container as defined in claim 36, wherein said upper and lower front extensions are coplanar with one another.

38. The container as defined in claim 35, having a rectangular-shaped top and bottom.

39. A container for transporting a product, comprising:

a top wall panel;

a bottom wall panel;

a back wall panel;

a lower front extension extending from said bottom wall panel toward said top wall panel;

an upper front extension extending from said top wall panel toward said bottom wall panel, said upper and lower front extensions separated by a display opening for the product;

a pair of side wall panels extending from said back wall panel;

each of said side wall panels having an extension formed and hinged along an outer edge of said side wall panel, said extension folded such that said extension provides a generally front-facing, double fold front surface for the container elongated in a direction generally transverse to said top and bottom wall panels and spaced to the rear of each of said upper and lower front extensions.

40. The container as defined in claim 39, wherein said upper and lower front extensions are coplanar with one another.

41. The container as defined in claim 39, having a rectangular-shaped top and bottom.

42. A container for transporting a vanity top having a basin portion, a counter portion about the basin portion, an underside and a top side, comprising:

a top wall;

a bottom wall;

a back wall;

a lower front extension extending from said bottom wall toward said top wall;

an upper front extension extending from said top wall toward said bottom wall, said upper and lower front extensions separated by a display opening for the vanity top;

a pair of side walls connected to said back wall; and panel structure to support the vanity top by abutting the underside of a non-basin portion of the vanity top with the top side of the basin portion of the vanity top facing toward said display opening, said panel structure including a pair of end flaps, each formed and hinged along an upper edge of a said side wall, folded to provide said support.

43. The container as defined in claim 42, formed integrally from a planar sheet of stiffened packing material.

44. The container as defined in claim 42, wherein said back wall has a rectangular shape.

45. The container as defined in claim 42, wherein each of said end flaps has at least two flap portions hinged to one another.

46. The container as defined in claim 42, having a rectangular-shaped top and bottom.

47. A container for transporting a vanity top having a basin portion, a counter portion about the basin portion and splash panel extending from said basin portion, comprising:

a top wall panel;

a bottom wall panel;

a back wall panel, a lower front extension extending from said bottom wall panel toward said top wall panel;

an upper front extension extending from said top wall panel toward said bottom wall panel, said upper and lower front extensions separated by a display opening for the product;

a pair of side wall panels extending from said back wall panel;

each of said side wall panels having an extension formed and hinged along an outer edge of said side wall panel, said extension folded such that said extension provides a generally front-facing, double fold front surface for the container elongated in a direction generally transverse to said top and bottom wall panels spaced to the rear of each of said upper and lower front extensions and sized to block rearward movement of the product.

48. The container as defined in claim 47, wherein said extension from each of said side wall panels is at least in part in overlying adjacent relation relative to said side wall panel.

49. The container as defined in claim 47, having a rectangular-shaped top and bottom.

50. A container for transporting a product, comprising:

a top wall panel;

a bottom wall panel;

a back wall panel;

a lower front extension extending from said bottom wall panel toward said top wall panel;

an upper front extension extending from said top wall panel toward said bottom wall panel, said upper and lower front extensions separated by a display opening for the product;

a pair of side wall panels extending from said back wall panel;

each of said side wall panels having an extension formed and hinged along an outer edge of an intermediate portion of said side wall panel substantially spaced from the top and the bottom of said side wall panel, said extension folded such that said extension provides a generally front-facing, double fold surface for the container;

each of said side walls with its extension together having at least one locking projection adapted to interlock said side wall and its extension for releasably maintaining said extension folded relative to said side wall.

51. The container as defined in claim 50 wherein each of said side walls together with its extension has at least one opening, said locking projection and said opening coacting for releasably maintaining said extension folded relative to said side wall.

52. The container as defined in claim 51 wherein each of said side walls has said locking projection and each of said extensions has said opening.

53. The container as defined in claim 50 wherein each of said side walls has said locking projection.

54. The container as defined in claim 50 wherein said locking projection is formed as a cut-out.

* * * * *

UNITED STATES PATENT AND TRADEMARK OFFICE

CERTIFICATE OF CORRECTION

PATENT NO. : 5,579,991

DATED : December 3, 1996

INVENTOR(S) : Steven A. Strasevicz & Robert Shoults

It is certified that error appears in the above-identified patent and that said Letters Patent are hereby corrected as shown below:

In column 1, line 25, replace "port&on" with --portion--.

Signed and Sealed this

Twenty-fifth Day of February, 1997

*Attest:*

BRUCE LEHMAN

*Attesting Officer*

*Commissioner of Patents and Trademarks*